US010673167B2

(12) United States Patent
Rangi et al.

(10) Patent No.: US 10,673,167 B2
(45) Date of Patent: Jun. 2, 2020

(54) LOW-FORCE PUSH-IN ELECTRICAL TERMINAL

(71) Applicant: Lear Corporation, Southfield, MI (US)

(72) Inventors: Bhupinder Rangi, Novi, MI (US); Michael Glick, Farmington Hills, MI (US); David Menzies, Linden, MI (US); Lewis Galligan, Novi, MI (US)

(73) Assignee: Lear Corporation, Southfield, MI (US)

( * ) Notice: Subject to any disclaimer, the term of this patent is extended or adjusted under 35 U.S.C. 154(b) by 0 days.

(21) Appl. No.: 16/124,597

(22) Filed: Sep. 7, 2018

(65) Prior Publication Data

US 2020/0083629 A1 Mar. 12, 2020

(51) Int. Cl.

| | |
|---|---|
| ***H01R 4/24*** | (2018.01) |
| ***H01R 4/26*** | (2006.01) |
| ***H01R 11/20*** | (2006.01) |
| ***H01R 4/48*** | (2006.01) |
| ***H01R 13/424*** | (2006.01) |
| ***H01R 43/20*** | (2006.01) |

(52) U.S. Cl.

CPC ..... *H01R 13/424* (2013.01); *H01R 4/4818* (2013.01); *H01R 43/20* (2013.01)

(58) Field of Classification Search

CPC ..... H01R 11/11; H01R 11/01; H01R 11/24; H01R 11/22; H01R 4/4818; H01R 4/4836; H01R 4/4845; H01R 4/4872

USPC ..... 439/436–441, 834–835

See application file for complete search history.

(56) References Cited

U.S. PATENT DOCUMENTS

| | | | | |
|---|---|---|---|---|
| 2,946,036 | A * | 7/1960 | Bettencourt | H01H 1/5844 439/441 |
| 4,385,794 | A * | 5/1983 | Lucius | H01R 4/2466 439/399 |
| 5,007,865 | A * | 4/1991 | Jakobeit | H01R 13/18 439/839 |
| 5,551,150 | A * | 9/1996 | Zielinski | H01R 13/187 29/882 |
| 5,624,273 | A * | 4/1997 | Myer | H01R 4/2466 439/399 |
| 5,924,887 | A * | 7/1999 | Aoyama | H01R 4/2466 439/400 |
| 7,192,318 | B2 * | 3/2007 | Hotea | H01R 13/113 439/397 |
| 7,927,132 | B1 * | 4/2011 | Lin | H01R 4/4809 439/527 |
| 8,128,426 | B2 | 3/2012 | Glick et al. | |
| 8,408,952 | B2 * | 4/2013 | Wu | H01R 4/4818 439/441 |
| 8,579,651 | B2 * | 11/2013 | Hanning | H01R 4/4836 439/441 |

(Continued)

*Primary Examiner* — Abdullah A Riyami
*Assistant Examiner* — Thang H Nguyen
(74) *Attorney, Agent, or Firm* — MacMillan, Sobanski & Todd, LLC

(57) ABSTRACT

An electrical terminal includes a terminal base. A mate portion is attached to the terminal base and is adapted to mate with a corresponding electrical terminal. A conductor contact portion includes a box attached to the terminal base. The box defines an interior space. A lever extends from a wall of the box. The lever includes a curved portion that extends toward the terminal base. The lever is adapted to engage a conductor of a wire inserted into the box. The lever includes lift tabs that extend from the lever to outside the box.

19 Claims, 6 Drawing Sheets

(56) References Cited

U.S. PATENT DOCUMENTS

| | | | | |
|---|---|---|---|---|
| 8,616,926 | B2 * | 12/2013 | Byrne | H01R 11/22 439/861 |
| 10,193,244 | B2 * | 1/2019 | Aboulkassem | H01R 4/4845 |

* cited by examiner

LOW-FORCE PUSH-IN ELECTRICAL TERMINAL

BACKGROUND OF THE INVENTION

This invention relates to an electrical terminal. More specifically, this invention relates to an electrical terminal with a push-in connection for an electrical wire.

Electrical terminals are normally used in matching pairs in order to allow electrical connections to be made between electrical wires or electrical devices. A typical electrical terminal is made of an electrically-conductive material and includes a mate portion that engages the matching electrical terminal and a contact portion that engages the electrical wire. In order to provide a desired flow of electrical current between the wire and the electrical terminal, the contact portion provides an electrical connection between the electrical terminal and a conductor portion of the electrical wire. Additionally, in order to prevent the wire from pulling away from the electrical terminal, the contact portion maintains a physical connection with the electrical wire.

Common types of connections used in the contact portion include crimped, welded, or push-in connections. It would be advantageous to have an alternative electrical terminal with a push-in connection.

SUMMARY OF THE INVENTION

The invention relates to an electrical terminal. The electrical terminal includes a terminal base. A mate portion is attached to the terminal base and is adapted to mate with a corresponding electrical terminal. A conductor contact portion includes a box attached to the terminal base. The box defines an interior space. A lever extends from a wall of the box. The lever includes a curved portion that extends toward the terminal base. The lever is adapted to engage a conductor of a wire inserted into the box. The lever includes lift tabs that extend from the lever to outside the box.

In another embodiment, the invention relates to an electrical connector assembly. The electrical connector assembly includes an electrical terminal. The electrical terminal has a terminal base. A mate portion is attached to the terminal base and adapted to mate with a corresponding electrical terminal. A conductor contact portion includes a lever that extends toward the terminal base. The lever is adapted to engage a conductor of a wire. The lever includes lift tabs. The electrical connector assembly also includes an electrical connector. The electrical connector includes a terminal slot. The electrical connector is movable between a pre-lock position and a locked position. In the pre-lock position, the electrical terminal is located in the terminal slot, and the electrical connector engages the lift tabs to move the lever away from the terminal base. In the locked position, the connector retains the electrical terminal in the terminal slot and the lever is biased toward the terminal base.

In another embodiment, the invention relates to a method of connecting a wire to an electrical connector assembly. The method includes providing an electrical connector assembly with an electrical terminal held in a housing and a terminal position assurance attached to the housing in a pre-lock position. The terminal position assurance engages a conductor contact portion of the electrical terminal to maintain it in a pre-lock position. The method includes inserting a wire into the electrical terminal assembly. The method further includes moving the terminal position assurance to a locked position relative to the housing. In the locked position, the terminal position assurance allows the conductor contact portion of the electrical terminal to move to a locked position wherein the conductor contact portion engages a conductor of the wire. In the locked position, the terminal position assurance also engages an insulation contact portion of the electrical terminal to press the insulation contact portion into engagement with an insulator of the wire.

Various aspects of this invention will become apparent to those skilled in the art from the following detailed description of the preferred embodiment, when read in light of the accompanying drawings.

DETAILED DESCRIPTION OF THE PREFERRED EMBODIMENT

Figure 1:
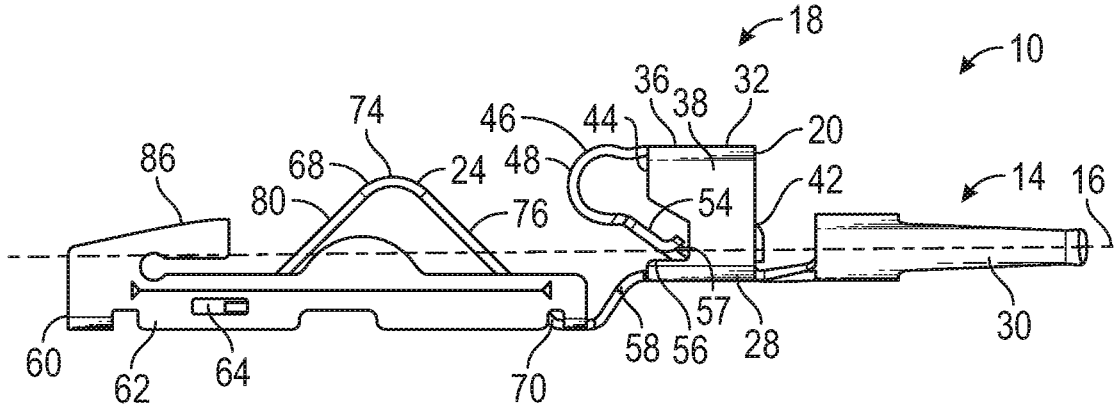
FIG. 1 is a side view of an electrical terminal that includes a push-in wire connector.
Figure 2:
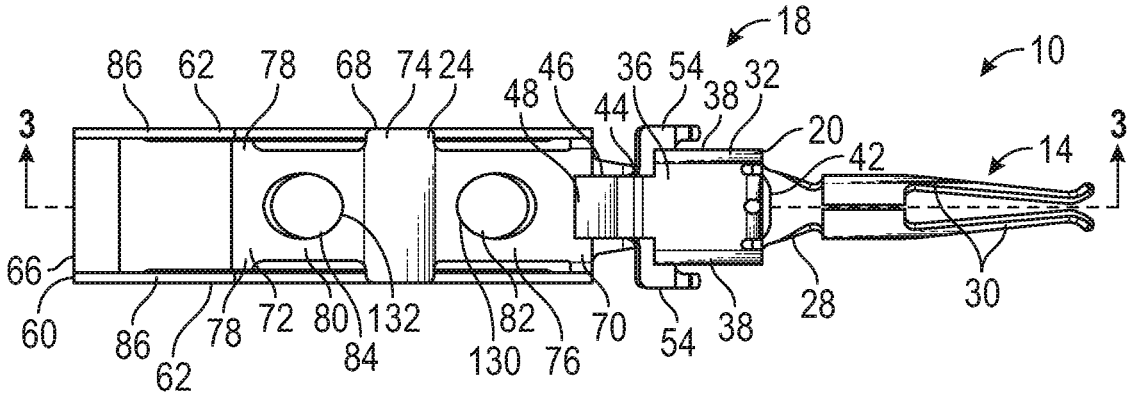
FIG. 2 is a top view of the electrical terminal illustrated in FIG. 1.
Figure 3:
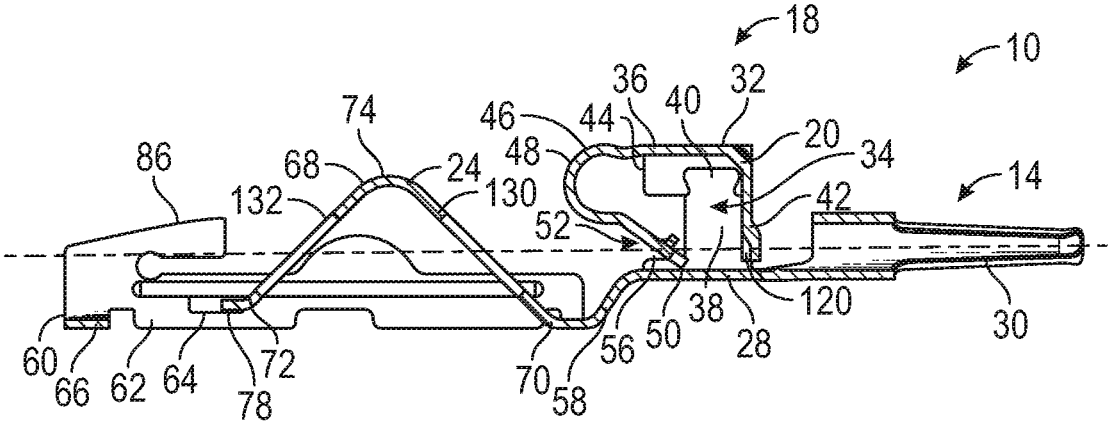
FIG. 3 is a cross-sectional view of the electrical terminal taken along the line 3-3 of FIG. 2.

Referring now to the drawings, there is illustrated in FIG. 1*a* side view of an electrical terminal, indicated generally at 10, in accordance with the invention. The illustrated electrical terminal 10 is made from a single sheet of metal that is stamped and folded into the configuration shown. However, the electrical terminal 10 may be made from any desired material and by any desired process. FIG. 2 is a top view of the electrical terminal 10, and FIG. 3 is a cross-sectional view of the electrical terminal 10 taken along line 3-3 of FIG. 2.

The electrical terminal 10 includes a mate portion, indicated generally at 14, that is configured to be mated with a corresponding electrical terminal (not shown). The illustrated mate portion 14 is a two-armed female terminal that is configured to mate with a male pin-type terminal inserted along a terminal axis 16. However, the mate portion 14 may be any desired type of connection.

Figure 4:
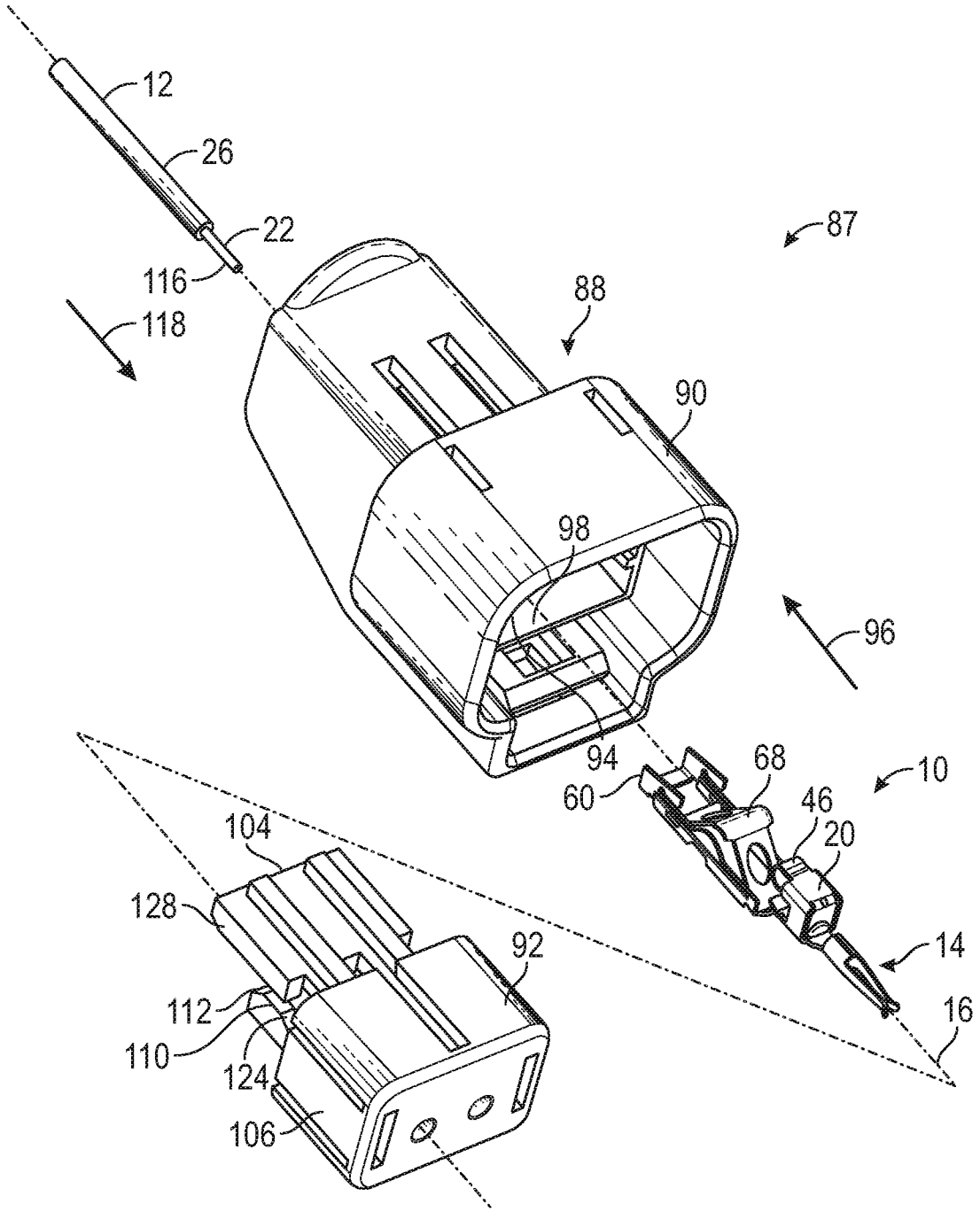
FIG. 4 is an exploded, perspective view of an electrical terminal assembly, including the electrical terminal illustrated in FIG. 1 and an electrical connector shown prior to assembly.

The electrical terminal 10 also includes a contact portion, indicated generally at 18, that is configured to engage a wire 12 (shown in FIG. 4). The contact portion 18 includes a conductor contact portion 20, which is configured to engage a conductor 22 of the wire 12 to provide electrical contact between the electrical terminal 10 and the conductor 22. The contact portion 18 also includes an insulation contact portion 24 that is configured to engage an insulator 26 of the wire 12. The connection of the electrical terminal 10 will be described in detail below.

The electrical terminal 10 includes a terminal base 28. The illustrated terminal base 28 is a continuous piece that extends from the mate portion 14 through the conductor contact portion 20 to the insulation contact portion 24. The mate portion 14 includes two terminal arms 30 that extend from the terminal base 28 and are located on opposed sides of the terminal axis 16.

The conductor contact portion 20 includes a box 32 that extends from the terminal base 28. The box 32 defines an interior space, indicated generally at 34. The illustrated box 32 is positioned so that the terminal axis 16 extends through the interior space 34. The illustrated box 32 includes an outer wall 36 that is located on an opposed side of the interior space 34 from the terminal base 28. Two side walls 38 are located on opposed sides of the interior space 34 and extend from the terminal base 28 to the outer wall 36. In the illustrated embodiment, one of the side walls 38 includes a dovetail lock 40 (seen in FIG. 3). The dovetail lock 40 helps retain the box 32 in its assembled state. However, the box 32 may be held together by any desired connector or mechanism.

The conductor contact portion 20 also includes a front wall 42 that is located between the interior space 34 and the mate portion 14. In the illustrated embodiment, the front wall 42 is made from pieces of material that are folded from the outer wall 36 toward the terminal base 28. However, the front wall 42 may extend from any desired part of the electrical terminal 10. The box 32 includes an open side 44 which allows for insertion of the wire 12 into the interior space 34, as will be described below. In the illustrated embodiment, the open side 44 is located opposite the front wall 42, but may be on any desired portion of the box 32.

The conductor contact portion 20 includes a lever 46 that serves to engage the wire 12, as will be described below. The illustrated lever 46 is stamped from the same piece of material as the rest of the electrical terminal 10, but the lever 46 may be a separate component if desired. The illustrated lever 46 extends from the outer wall 36 of the box 32, but may extend from any desired part of the electrical terminal 10. The lever 46 extends from the box 32, and at least a portion of the lever 46 is located outside the interior space 34 of the box 32. The lever 46 extends through the open side 44 of the box 32 into the interior space 34. The lever 46 includes a curved portion 48 where the lever 46 is bent so that the extended portion of the outer wall 36 extends into the interior space 34. The curved portion 48 may have any desired size or curvature. The lever 46 is shown in an initial position in FIGS. 1-3.

The lever 46 extends from the outer wall 36 toward the opposed side of the box 32. In the illustrated embodiment, the lever 46 extends from the outer wall 36 toward the terminal base 28. However, the lever 46 may extend toward any desired part of the electrical terminal 10. The lever 46 includes an engagement edge 50, which is the part of the lever 46 that is nearest the terminal base 28. The engagement edge 50 is the part of the lever 46 that engages the wire 12, as will be described the below. In the illustrated embodiment, the engagement edge 50 is a distal end of the lever 46, but may be any desired part of the lever 46. The engagement edge 50 of the lever 46 is located in the interior space 34 of the box 32.

Figure 5A:
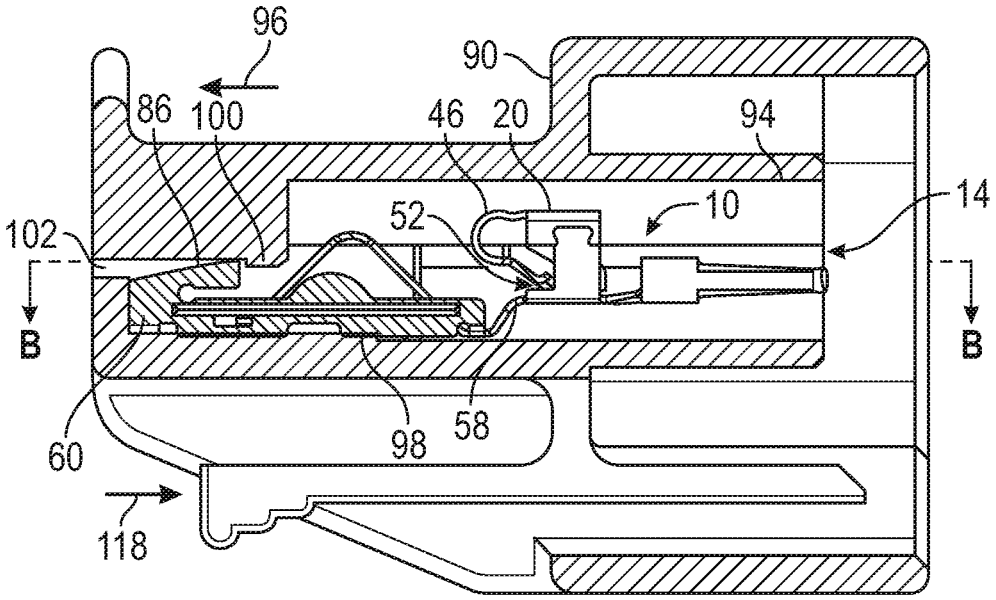
FIG. 5A is a cross-sectional view of a housing of the electrical connector, with the electrical terminal shown in a seated position in the housing.

The lever 46 and the terminal base 28 define an insertion channel, indicated generally at 52 in FIGS. 3 and 5A, therebetween. The insertion channel 52 extends from the engagement edge 50 of the lever 46 toward the open side 44 of the box 32. The illustrated insertion channel 52 is wedge-shaped, being widest at the open side 44 and narrowest at the engagement edge 50, although such is not required.

The lever 46 includes two lift tabs 54 that extend from opposed sides of the lever 46. The illustrated lift tabs 54 extend from the lever 46 between the curved portion 48 and the engagement edge 50. The illustrated lift tabs 54 also extend from a part of the lever 46 that is located in the interior space 34 of the box 32. However, the lift tabs 54 may extend from any desired part of the lever 46. In the illustrated embodiment, each side wall 38 defines a tab opening 56 that allows one of the lift tabs 54 to extend from the interior space 34 out of the box 32. However, the lift tabs 54 may be located or shaped such that there are no tab openings 56. In the illustrated embodiment, each lift tab 54 includes a guide surface 57 that is a curved surface formed by a part of the lift tab 54 bent away from the terminal base 28. The purpose of the lift tabs 54 will be described below.

In the illustrated embodiment, the distance between the terminal axis 16 and the terminal base 28 is different at different parts of the electrical terminal 10. The terminal base 28 includes an offset 58 that is located between the conductor contact portion 18 and the insulation contact portion 24. In the conductor contact portion 18, the terminal base 28 is closer to the terminal axis 16 than it is in the insulation contact portion 24. The offset 58 allows the wire 12 to be inserted into the electrical terminal 10 while being coaxial with the terminal axis 16, as described below. The size of the offset 58 can be selected depending on the relative sizes of the terminal arms 30, the conductor 22, and the insulator 26.

The insulation contact portion 24 extends from the offset 58 to an insertion end 60 of the electrical terminal 10. The terminal base 28 includes two struts 62 that extend substantially between the offset 58 the insertion end 60. The illustrated struts 62 are mirror-images of each other, but may have different shapes if desired. Each strut 62 includes a guide channel 64. The illustrated guide channels 64 are slots that are punched through the respective strut 62. Each of the guide channels 64 extends parallel to the terminal axis 16. The electrical terminal 10 includes a strut connection 66 at the insertion end 60 that is attached to each of the struts 62 to prevent the struts 62 from deflecting from their relative positions.

The insulation contact portion 24 includes a resilient, V-shaped wire contact 68. The wire contact 68 includes a fixed end 70, a free end 72, and an intermediate peak 74. The fixed end 70 of the wire contact 68 extends from the terminal base 28 near the offset 58. The fixed end 70 is located between the two struts 62, and a first wing 76 of the wire contact 68 extends from the fixed end 70 to the peak 74.

The free end 72 of the wire contact 68 includes two guide tabs 78 that extend from opposed sides of the free end 72. Each of the guide tabs 78 is located in one of the guide channels 64 on the struts 62. The guide tabs 78 are not fixed to the struts 62 and, thus, are able to move in the respective guide channel 64 relative to the struts 62 in a direction generally parallel to the terminal axis 16. A second wing 80 of the wire contact 68 extends from the free end 72 to the peak 74.

The peak 74 is a curved portion of the wire contact 68 located where the first wing 76 and the second wing 80 meet.

In the illustrated embodiment, the peak 74 and the terminal base 28 are located on opposed sides of the terminal axis 16. The peak 74 may have any desired shape or orientation.

The wire contact 68 includes a first wire contact opening 82 that extends through the first wing 76. The illustrated first wire contact opening 82 has an elliptical shape, but may have any desired shape. The terminal axis 16 passes through the center of the illustrated first wire contact opening 82, but the first wire contact opening 82 may be in any desired position. The wire contact 68 also includes a second wire contact opening 84 that extends through the second wing 80. The illustrated second wire contact opening 84 has an elliptical shape, but may have any desired shape. The terminal axis 16 passes through the center of the illustrated second wire contact opening 84, but the second wire contact opening 84 may be in any desired position.

The electrical terminal 10 includes a terminal lock. The illustrated terminal lock includes a pair of resilient arms 86. Each resilient arm 86 extends from one of the struts 62 near the insertion end 60, and extends toward the contact portion 14. The operation of the terminal lock will be described below.

Referring to FIG. 4, there is illustrated a perspective view of an electrical connector assembly, indicated generally at 87, shown prior to assembly. The electrical connector assembly 87 includes both the electrical terminal 10 and an electrical connector, indicated generally at 88. The electrical connector 88 includes a housing 90 and a terminal position assurance (TPA) 92. The illustrated housing 90 is molded from plastic, but may be made by any desired material and process. The housing 90 includes a terminal slot 94 that is adapted to hold the electrical terminal 10 for mating with a corresponding terminal (not shown) when the electrical connector 88 is mated with a corresponding connector (not shown). Although only the single electrical terminal 10 is shown, the illustrated housing 90 is able to hold two electrical terminals, and the housing 90 may be configured to hold any desired number of electrical terminals.

Figure 5B:
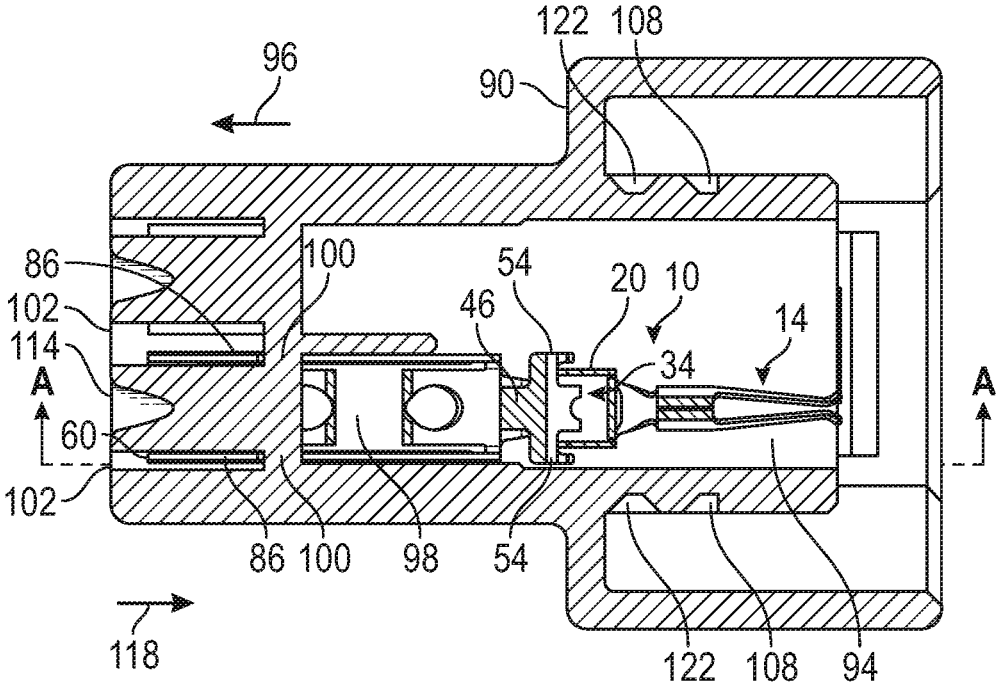
FIG. 5B is a cross-sectional view taken along the line B-B of FIG. 5A.

Referring to FIG. 5A, there is illustrated a cross-section view taken through the terminal slot 94 when the electrical terminal 10 is in a seated position in the housing 90. FIG. 5B is a cross-sectional view taken along line B-B of FIG. 5A. The electrical terminal 10 is moved to the seated position by moving the insertion end 60 into the terminal slot 94 in a mate direction 96. In the illustrated embodiment, the mate direction 96 is parallel to the terminal axis 16, but may have any desired orientation. The housing 90 includes a terminal support 98 on one side of the terminal slot 94, and a portion of the terminal base 28 is positioned adjacent to the terminal support 98.

The housing 90 includes a terminal retainer 100 that holds the electrical terminal 10 in the terminal slot 94. The illustrated terminal retainer 100 is a pair of tabs (one is visible in FIG. 5A and two are visible in FIG. 5B). As the electrical terminal 10 is moved in the mate direction 96 relative to the housing 90, each resilient arm 86 on the electrical terminal 10 engages one of the tabs 100 and is deflected. When the electrical terminal 10 is moved to the seated position, the resilient arms 86 rebound to the position shown in FIG. 5A and will engage the tabs 100 to prevent the electrical terminal 10 from being removed from the housing 90. The housing 90 includes release openings 102 that allow a tool (not shown) to be inserted into the housing 90 to deflect the resilient arms 86 so that the terminal lock can be disengaged from the terminal retainer 100. This allows the electrical terminal 10 to be removed from the housing 90 to be repaired or replaced, if desired.

Figure 6A:
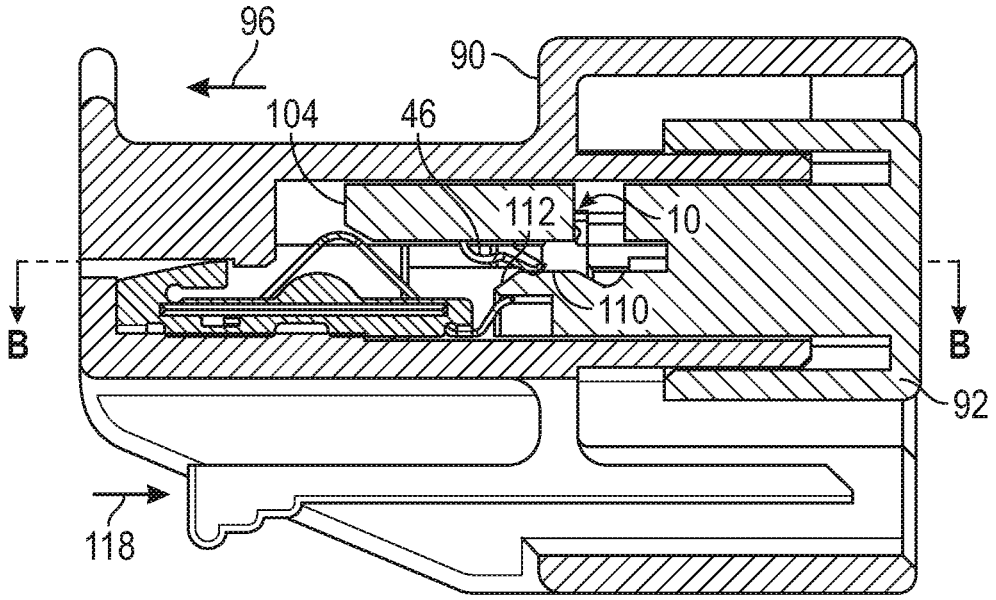
FIG. 6A is a cross-sectional view similar to FIG. 5A showing a terminal position assurance engaged with the terminal in a pre-lock position.
Figure 6B:
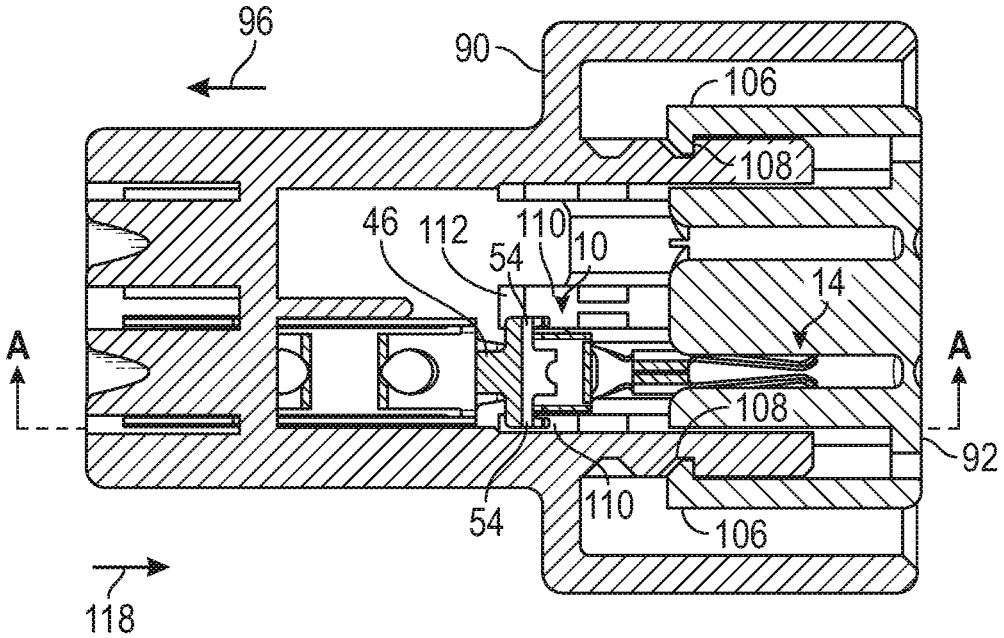
FIG. 6B is a cross-sectional view taken along line B-B of FIG. 6B.

Referring to FIG. 6A, a view similar to FIG. 5A is illustrated showing the TPA 92 in a pre-lock position relative to the housing 90. FIG. 6B is a cross-sectional view taken along line B-B of FIG. 6A. The illustrated TPA 92 is moved to the pre-lock position by positioning the TPA 92 with an insertion end 104 facing the housing 90 and moving the TPA 92 in the mate direction 96 relative to the housing 90.

The TPA 92 includes TPA locks 106 that retain the TPA 92 in the pre-lock position relative to the housing 90. The illustrated TPA locks 106 include resilient arms located on opposed sides of the terminal slot 94. Each resilient arm includes a tab that engages a respective pre-lock slot 108 on the housing 90. The illustrated TPA 92 includes two resilient arms, but may include any desired number or type of TPA lock.

The TPA 92 includes a lever switch 110 that engages the electrical terminal 10 to move the lever 46 from the initial position (shown in FIGS. 1 through 5B) to a pre-lock position (shown in FIGS. 6A and 6B). In the pre-lock position, the lever 46 is lifted away from the terminal base 28 and the insertion channel 52 is made larger. Additionally, the lever 46 is moved so that the terminal axis 16 does not pass through the lever 46. Rather, when the lever 46 is in the pre-lock position, the terminal axis 16 passes between the lever 46 and the terminal base 28.

In the illustrated embodiment, the TPA 92 includes two lever switches 110 on opposite sides of the electrical terminal 10, adjacent to the side walls 38. Each lever switch 110 engages one of the lift tabs 54 when the TPA 92 is in the pre-lock position. Each lever switch 110 includes a lift surface 112 that is sloped relative to the terminal axis 16. As the TPA 92 is moved into the pre-lock position, the lift surface 112 engages the guide surface 57 on the respective lift tab 54 and biases the lever 46 away from the terminal base 28.

Figure 7A:
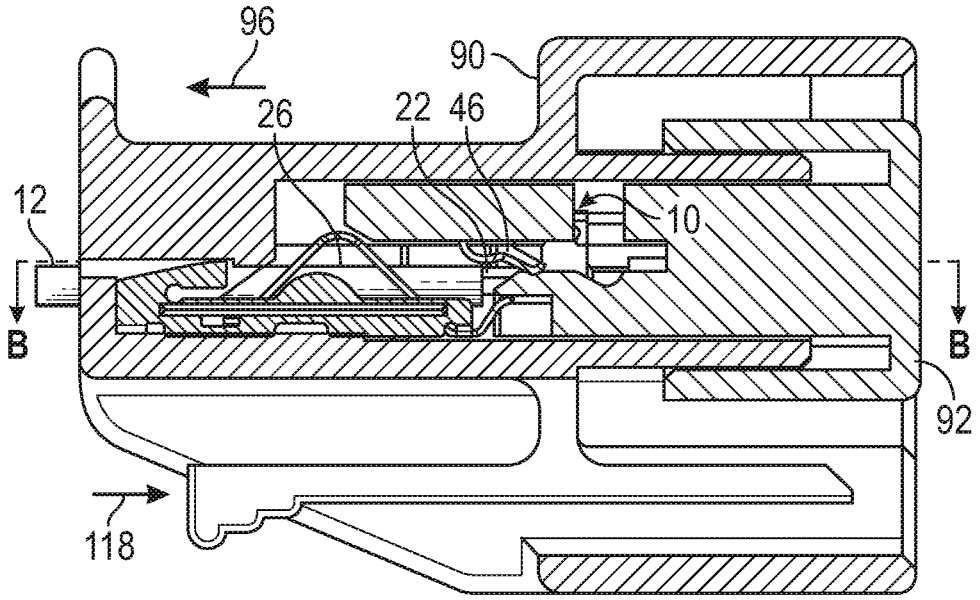
FIG. 7A is a cross-sectional view similar to FIG. 6A showing a wire inserted into the electrical terminal.
Figure 7B:
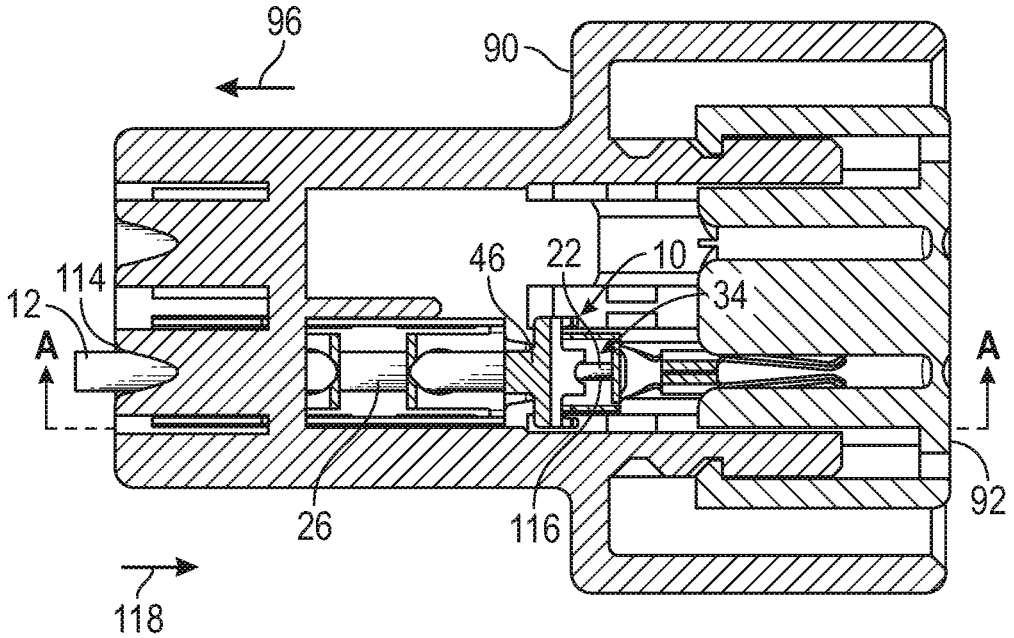
FIG. 7B is a cross-sectional view taken along line B-B of FIG. 7B.

Referring to FIG. 7A, a view similar to FIG. 6A is illustrated showing the wire 12 in an inserted position relative to the electrical terminal 10. FIG. 7B is a cross-sectional view taken along line B-B of FIG. 7A. The housing 90 includes a wire opening 114 that allows the wire to be inserted into the housing 90 and into the terminal slot 94. In the illustrated embodiment, the terminal axis 16 passes through the wire opening 114. However, the wire opening 114 may have any desired orientation.

As shown in the FIG. 4, the wire 12 includes an exposed end 116 where a portion of the conductor 22 is exposed by removal of a portion of the insulator 26 from the wire 12. To attach the electrical terminal 10 to the wire 12, the wire 12 is initially positioned adjacent to the housing 90 and is then moved into the wire opening 114 in an insertion direction 118. In the illustrated embodiment, the insertion direction 118 is parallel to the terminal axis 16 and is opposite the mate direction 92. However, the insertion direction 118 may have any desired orientation.

The exposed end 116 of the wire 12 is moved through the wire opening 114, through the second wire contact opening 84 on the wire contact 68 of the electrical terminal 10, through the first wire contact opening 82, and into the interior space 34 of the box 32. With the lever 46 in the pre-lock position, the conductor 22 of the wire 12 is able to be inserted into the insertion channel 52 between the terminal base 28 and the engagement edge 50 of the lever 46 without engaging the lever 46. Thus, the lever 46 is not displaced by the insertion of the wire 12. This reduces the amount of force required to insert the wire 12 into the electrical terminal 10. Alternatively, the lever 46 in the pre-lock position may be in a position where the conductor 22 does engage the lever 46, if desired. The wire 12 is continued to be moved in the insertion direction 118 until the conductor 22 engages a wire stop 120 (shown in FIG. 3) on the box 32, which prevents further movement of the conductor 22 in the insertion direction 118. In the illustrated embodiment, the wire stop 120 is a portion of the front wall 42.

Figure 8A:
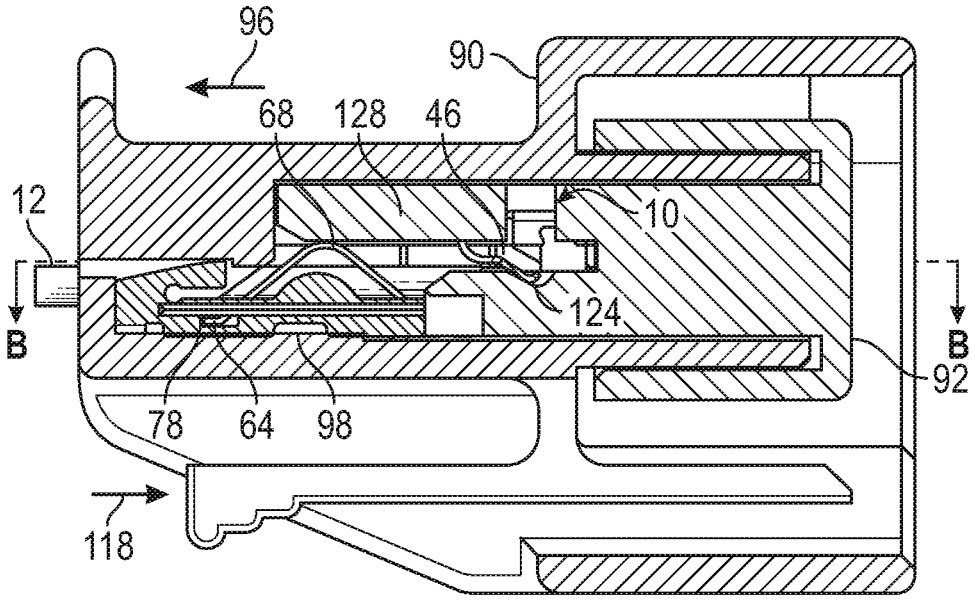
FIG. 8A is a cross-sectional view similar to FIG. 7A showing the terminal position assurance in a locked position.
Figure 8B:
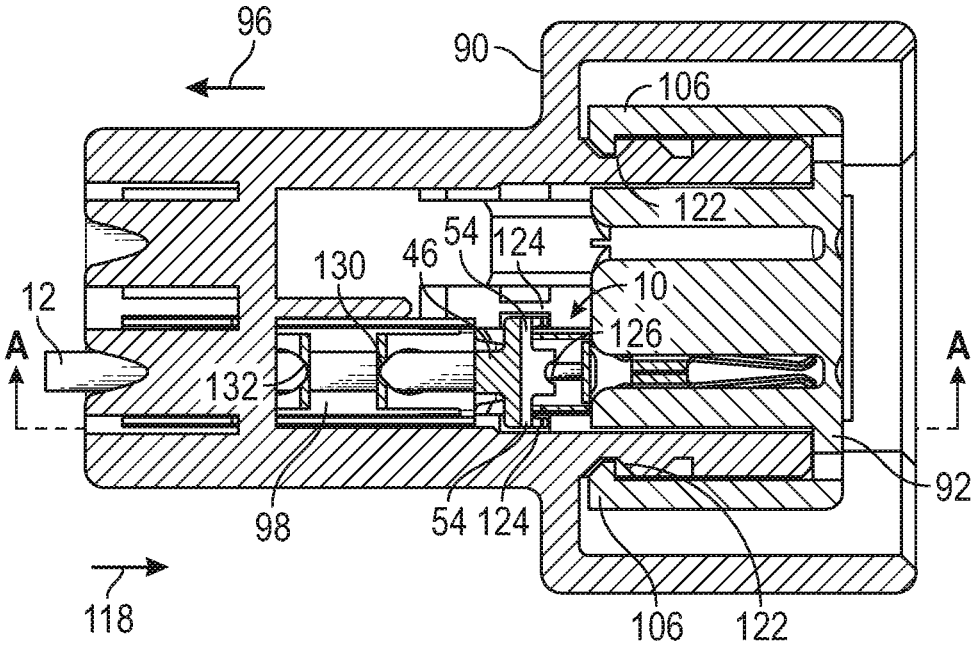
FIG. 8B is a cross-sectional view taken along line B-B of FIG. 8A.

Referring to FIG. 8A, a view similar to FIG. 7A is illustrated showing the TPA 92 in a locked position relative to the housing 90. FIG. 8B is a cross-sectional view taken along line B-B of FIG. 8A. The illustrated TPA 92 is moved to the locked position by moving the TPA 92 from the pre-lock position (shown in FIGS. 7A and 7B) in the mate direction 92 relative to the housing 90.

When the TPA 92 is moved in the mate direction 92 from the pre-lock position, the TPA locks 106 are biased out of the pre-lock slots 108. When the TPA 92 is moved to the locked position, the TPA locks 106 rebound into final lock slots 122 on the housing 90.

When the TPA 92 is in the locked position, the lever switch 110 allows the lever 46 to move from the pre-lock position to a locked position. In the locked position, the lever 46 is moved toward the terminal base 28 and the insertion channel 52 is made smaller. This allows the engagement edge 50 of the lever 46 to engage the conductor 22 of the wire 12.

In the illustrated embodiment, the TPA 92 includes switch wells 124 that are located adjacent to the lever switches 110. The switch wells 124 are portions of the TPA 92 that are closer to the terminal base 28 than the lever switches 110. When the TPA 92 is moved to the locked position, each lift tab 54 enters one of the switch wells 124, and the resilient lever 46 rebounds toward the terminal base 28. Because the conductor 22 is located between the lever 46 and the terminal base 28, the engagement edge 50 of the lever 46 engages the conductor 22, and the resilient lever 46 presses against the conductor 22. The lever 46 also presses the conductor 22 against the terminal base 28. The illustrated lever 46 includes a conductor notch 126 (see FIG. 8B) on the engagement edge 50. The illustrated conductor notch 126 is a cut-out portion of the engagement edge 50 of the lever 46 that has a generally semi-circular shape. The conductor 22 is located partially in the conductor notch 126, which increases the contact area between the lever 46 and the conductor 22. The engagement of the conductor 22 with the lever 46 and the terminal base 28 provides an electrical connection between the conductor 22 and the electrical terminal 10.

The engagement of the conductor 22 with the lever 46 and the terminal base 28 also resists the wire 12 from being removed from the electrical terminal 10. If a force is applied to move the wire 12 opposite the insertion direction 118 relative to the electrical terminal 10, the lever 46 will be pulled opposite the insertion direction 118 and will pinch the conductor 22 between the lever 46 and the terminal base 28.

The TPA 92 also includes a wire lock 128 which engages the wire contact 68 in order to press the wire contact 68 into a locked position in engagement with the wire 12. The wire lock 128 is located in the terminal slot 94 so that the electrical terminal 10 is located between the terminal support 98 and the wire lock 128. The wire lock 128 engages the peak 74 of the wire contact 68 and pushes the peak 74 toward the terminal base 28. As a result, the free end 72 of the wire contact 68 is pushed toward the insertion end 60 of the electrical terminal 10. The guide tabs 78 located in the guide channels 64 restrict how far the free end 72 is able to move away from the terminal axis 16. In the illustrated embodiment, when the wire 12 is in the inserted position, the portions of the wire 12 in the wire contact openings 82 and 84 include the insulator 26. When the TPA 92 is moved to the locked position, the first wing 76 and the second wing 80 are moved so that a first engagement edge 130 and a second engagement edge 132 are pushed into the insulator 26 of the wire 12. The engagement edges 130 and 132 are the portions of the wings 76 and 80 defining the sides of the wire contact openings 82 and 84 nearest the peak 74. The wire contact 68 is made of a harder material than the insulator 26, and the insulator 26 is displaced by the engagement edges 130 and 132.

When the TPA 92 is in the locked position, the insulation contact portion 24 resists the wire 12 being removed from the electrical terminal 10. A force applied to move the wire 12 away from the electrical terminal 10 will be resisted by the engagement of the wire contact 68 with the insulator 26 of the wire 12. If desired, the wire contact 68 may engage with the conductor 22 of the wire 12. Although the illustrated insulation contact portion 24 has been described in detail, the electrical terminal 10 may have any desired connection to the insulator 26 of the wire.

The principle and mode of operation of this invention have been explained and illustrated in its preferred embodiment. However, it must be understood that this invention may be practiced otherwise than as specifically explained and illustrated without departing from its spirit or scope.

What is claimed is:

1. An electrical terminal comprising:

a terminal base;

a mate portion extending from the terminal base and adapted to mate with a corresponding electrical terminal; and a conductor contact portion including a box extending from the terminal base and a lever extending from the box, the lever including a curved portion that extends toward the terminal base, the lever adapted to engage a conductor of a wire inserted into the box, the lever including lift tabs that extend from the lever to outside the box.

2. The electrical terminal of claim 1, wherein the lift tabs extend from the lever between the curved portion of the lever and a distal end of the lever.

3. The electrical terminal of claim 1, wherein the box includes side walls that include tab openings that the lift tabs pass through.

4. The electrical terminal of claim 1, further including a wire stop located between the box and the mate portion.

5. The electrical terminal of claim 1, further including an insulation contact portion attached to the terminal base and adapted to engage an insulator of the wire.

6. The electrical terminal of claim 1, further including a terminal position assurance that is movable to a pre-lock position relative to the electrical terminal, wherein the terminal position assurance engages the lift tabs to move the lever away from the terminal base.

7. The electrical terminal of claim 6, further including an insulation contact portion extending from the terminal base and adapted to engage an insulator of the wire.

8. The electrical terminal of claim 7, wherein the insulation contact portion includes a wire contact that is movable between an insertion position, wherein the electrical terminal is adapted for insertion of the wire, and a locked position, wherein the electrical terminal is adapted to retain the wire in position relative to the electrical terminal.

9. The electrical terminal of claim 8, wherein the terminal position assurance moves the wire contact to a locked position when the terminal position assurance is moved to the locked position.

10. An electrical connector assembly comprising:

an electrical terminal including a terminal base, a mate portion extending from the terminal base and adapted to mate with a corresponding electrical terminal, and a conductor contact portion including a lever that extends toward the terminal base, the lever adapted to engage a conductor of a wire, the lever including lift tabs;

an electrical connector including a terminal slot; and a terminal position assurance supported on the electrical connector and movable between a pre-lock position, wherein the electrical terminal is located in the terminal slot and the terminal position assurance engages the lift tabs to move the lever away from the terminal base, and a locked position, wherein the terminal position assurance retains the electrical terminal in the terminal slot and the lever is biased toward the terminal base.

11. The electrical connector assembly of claim 10, wherein the electrical terminal includes an insulation contact portion extending from the terminal base including a wire contact that is movable between an insertion position, wherein the electrical terminal is adapted for insertion of the wire, and a locked position, wherein the electrical terminal is adapted to retain the wire in position relative to the electrical terminal, wherein the terminal position assurance moves the wire contact to the locked position when the terminal position assurance is in the locked position.

12. The electrical connector assembly of claim 11, wherein the electrical connector includes a housing that defines the terminal slot.

13. The electrical connector assembly of claim 10, wherein the electrical connector includes a housing that defines the terminal slot.

14. The electrical connector assembly of claim 10, wherein the conductor contact portion includes a box extending from the terminal base and defining an interior space, wherein the lever extends from a wall of the box, the lever including a curved portion and extending toward the terminal base, the lever adapted to engage the conductor of the wire inserted into the box, wherein the lift tabs extend from the lever to outside the box.

15. The electrical connector assembly of claim 14, wherein the electrical connector includes a housing that defines the terminal slot.

16. The electrical connector assembly of claim 15, wherein terminal position assurance allows the lever to rebound toward the terminal base when the terminal position assurance is in the locked position.

17. The electrical connector assembly of claim 16, wherein the electrical terminal includes an insulation contact portion attached to the terminal base including a wire contact that is movable between an insertion position, wherein the electrical terminal is adapted for insertion of the wire, and a locked position, wherein the electrical terminal is adapted to retain the wire in position relative to the electrical terminal, wherein the electrical connector moves the wire contact to the locked position when the terminal position assurance is in the locked position.

18. The electrical connector assembly of claim 17, wherein the terminal position assurance includes a wire lock that engages the wire contact to move the wire contact to the locked position when the terminal position assurance is in the locked position.

19. A method of connecting a wire to an electrical connector assembly, the method comprising the steps of:

providing an electrical connector assembly including an electrical terminal held in a housing and a terminal position assurance attached to the housing in a pre-lock position, wherein the terminal position assurance engages a conductor contact portion of the electrical terminal to maintain it in a pre-lock position;

inserting a wire into the electrical terminal assembly; and moving the terminal position assurance to a locked position relative to the housing, wherein the terminal position assurance allows the conductor contact portion of the electrical terminal to move to a locked position wherein the conductor contact portion of the electrical terminal engages a conductor of the wire, and wherein the terminal position assurance engages an insulation contact portion of the electrical terminal to press the insulation contact portion into engagement with an insulator of the wire.

* * * * *